US007091457B2

(12) United States Patent
Gregoire et al.

(10) Patent No.: US 7,091,457 B2
(45) Date of Patent: Aug. 15, 2006

(54) META-SURFACE WAVEGUIDE FOR UNIFORM MICROWAVE HEATING

(75) Inventors: Daniel Gregoire, Thousand Oaks, CA (US); Daniel F. Sievenpiper, Santa Monica, CA (US); Weldon S. Williamson, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 9 days.

(21) Appl. No.: 10/987,413

(22) Filed: Nov. 12, 2004

(65) Prior Publication Data

US 2006/0102621 A1 May 18, 2006

(51) Int. Cl.
*H05B 6/70* (2006.01)

(52) U.S. Cl. ..... 219/690; 219/696; 219/745; 219/746; 219/750

(58) Field of Classification Search ..... 219/690, 219/695–691, 745–751
See application file for complete search history.

(56) References Cited

U.S. PATENT DOCUMENTS 3,622,732 A * 11/1971 Williams ..... 219/695
3,872,276 A * 3/1975 Corcoran et al. ..... 219/751
4,405,850 A 9/1983 Edgar
4,851,630 A * 7/1989 Smith ..... 219/687
4,963,709 A 10/1990 Kimrey, Jr.
5,220,142 A 6/1993 LaMaire et al.
5,222,543 A * 6/1993 Carlstrom et al. ..... 164/114
5,369,250 A 11/1994 Meredith
6,603,357 B1 8/2003 Higgins et al.

OTHER PUBLICATIONS

J. T. Bernhard, et al., "Dielectric Slab-Loaded Resonant Cavity for Applications Requiring Enhanced Field Uniformity", IEEE Transactions on Microwave Theory and Techniques, vol. 44, No. 3, Mar. 1996, pp. 457-460.*
Magdy Z. Mohamed, et al., "A Multipol Analysis of a Diectric Loaded Coaxial Rectangular Waveguide", IEEE Transactions on Microve Theory and Techniques, vol. 40, No. 3, Mar. 1992, pp. 482-494.*
Mekki Belaid, et al., "Spatial Power Amplifier Using a Passive and Active TEM Waveguide Concept", *IEEE Transactions on Microwave Theory and Techniques*, Mar. 2003, pp. 684-689, vol. 51, No. 3.

(Continued)

*Primary Examiner*—Philip H. Leung
(74) *Attorney, Agent, or Firm*—Christie, Parker & Hale, LLP

(57) ABSTRACT

A method and apparatus for creating uniform heating of an microwave absorptive target. A microwave housing has a longitudinal axis and propagates a waveguide mode at an operating frequency. The target is located in an axial cross-sectional area relative to the longitudinal axis. First layer conductive strips are layered proximal to an inner wall of the microwave housing, substantially parallel to the longitudinal axis and being separated from an adjacent first layer conductive strip by a respective first layer gap, the inner wall acting as a ground plane. Second layer conductive strips are layered proximal to the first layer of conductive strips, parallel to the longitudinal axis and being separated from an adjacent second layer conductive strip by a respective second layer gap. Each first layer gap is centered under a respective second layer conductive strip and each second layer gap is centered over a conductive layer.

15 Claims, 7 Drawing Sheets

OTHER PUBLICATIONS

R. G. Heeren, et al., "An Inhomogeneously Filled Rectangular Waveguide Capable of Supporting TEM Propagation," *IEEE Transaction on Microwave Theory and Techniques*, Nov. 1971, pp. 884-885.

J. Aiden Higgins, et al., "Ka-Band Waveguide Phase Shifter Using Tunable Electromagnetic Cyrstal Sidewalls, " *IEEE Transactions on Microwave Theory and Techniques*, Apr. 2003, pp. 1281-1288, vol. 51, No. 4.

D. A. Johnston, "Use of the TEM Mode in Microwave Heating Applicators," *IEEE Transactions on Microwave Theory and Techniques*, Aug. 1972, pp. 547-549.

Fei-Ran Yang, et al., "A Novel TEM Waveguide Using Uniplanar Compact Photonic-Bandgap (UC-PBC) Structure," *IEEE Transaction on Microwave Theory and Techniques*, Nov. 1999, pp. 2092-2098, vol. 47, No. 11.

* cited by examiner

META-SURFACE WAVEGUIDE FOR UNIFORM MICROWAVE HEATING

BACKGROUND OF THE INVENTION

1. Field of the Invention

The present invention relates to the field of heating, and more particularly, to the use of microwave radiation for heating slab-like layers or surfaces.

2. Description of the Related Art

The use of microwave radiation is a well known method for heating substances that have intrinsic absorption properties, but it is often difficult to remove the effects of cavity and waveguide modes that lead to non-uniform heating and "hot spots" in the target to be heated.

Many processes also require uniform heating and a method of applying heat energy noninvasively. For example, the use of microwave heating has been proven to be effective for the processing of dielectric material. In many cases, a uniform temperature distribution within the product is required.

There have been many proposals that use a TEM waveguide mode to create a uniform field distribution. A waveguide or cavity is loaded with high permittivity dielectric materials to enable the uniform TEM mode field distributions. The disadvantage is that many applications do not allow the inclusion of such material within the processing environment. Another disadvantage is that the loading material limits the space available within the cavity for the target.

Techniques have also been introduced that require a moving structure or a field enhancing structure within the interior of the heating cavity. In many cases, the added complexity is undesirable, such as, for example, a conveyer belt system moving over microwave emitting slots in a waveguide.

Other heating methods employ additional electrical structures within the cavity that alter the field distribution, such as, for example, an inserted control element positioned between an object being heated and a source of microwave radiation and employed to prevent a localized concentration of microwave energy resulting from a discontinuity in the object surface. However, close control is needed for heating an object with a sensitive coating.

High-frequency microwave sources have been proposed to reduce the spatial dimension of field variation and to facilitate the efficacy of multimode methods for time-averaged field uniformity, such as a 28-GHz source used for achieving uniformity within a small volume. This methodology relies on the disadvantage imposed by fixed-frequency microwave heating cavities that are known to have cold spots and hot spots. Such phenomena are attributed to the ratio of the wavelength to the size of the microwave cavity. With a relatively low frequency microwave introduced into a small cavity, standing waves occur and, thus, the microwave power does not uniformly fill all of the space within the cavity, and the unaffected regions are not heated. In the extreme case, the oven cavity becomes practically a "single-mode" cavity. At 2.45 GHz a far better uniformity of field can be obtained by increasing the cavity dimensions better than 100 times the wavelength which would require a cavity size of about 12 m. However, at this size a very large power supply would be required to produce a reasonable energy density within the cavity.

A proposed solution to the large power supply problem has been to go to higher frequencies, as high as 28 GHz where 100 times the wavelength is approximately 1 m in size. This is a far more manageable size of cavity and a reasonable energy density can be obtained with a moderate power source. However, a frequency of 28 GHz is considered to be prohibitively expensive for commercial use.

Hybrid heating ovens that incorporate airflow with the microwave heating are known to increase uniformity via convective heat transfer. However, in many cases, the increased complexity of introducing the airflow is prohibitive, or the desired process may be degraded by airflow.

In another method, a central conductor is imposed within a waveguide heating cavity to create the TEM field distribution. The central conductor is used as an air flow device to help unify the heating. However, many applications will not allow a central conductor within a heating cavity, such as, for example, a home microwave oven. In addition, TEM modes created in coaxial structures have electric fields that are non-uniform, falling off as the inverse of the distance from the axial conductor.

Attempts have also been made at mode stirring, or randomly deflecting the microwave beam, in order to break up the standing modes and thereby fill the cavity with the microwave radiation. One such attempt is the addition of rotating fan blades at the beam entrance of the cavity. This is essentially an empirical, non-deterministic technique based on statistical fluctuations in mode patterns. In cases where the cavity size is not large compared to a microwave wavelength, the number of modes available to be stirred is small and the statistical averaging in ineffective. These methods also rely on the inclusion of mechanical or electronic devices required to operate within the high-field, high-temperature processing environment. In many applications, this is undesirable.

A further method extending the deflecting approach involves the use of a circular cylindrical geometry where a bellows-type device is used to change the cavity's electrical length. By rapidly oscillating the length, many modes can come to bear on the sample and average out the heating to be more uniform. However, this requires a highly overmoded cavity and a complicated moving mechanical structure.

Another general method used to overcome the adverse effects of standing waves is to intentionally create a standing wave within a single-mode cavity such that the target may be placed at the location determined to have the highest power (the hot spot). Thus, only the portion of the cavity in which the standing wave is most concentrated will be used. This requires that the heating target is small compared to the cavity size and/or the mode structure cannot be altered from one target to another. It also does not lend itself to mass production, since other microwave cavity tuning devices, such as tuning stubs, are necessary for tuning the cavity for the desired mode. If the dielectric properties of the target change as it heats up, then the cavity resonance properties will also change, and the field distributions will also change in time.

Multiple microwave power sources and variable-frequency microwave sources are other solutions that have been proposed. The uniformity achieved through these approaches is dependent on having a statistically large number of modes available within the cavity, and they will work best when the cavity size is large compared to a wavelength. However, they impose a cost disadvantage. While 2.45 GHz/2 kW sources are very inexpensive and plentiful, any deviation from these parameters requires custom fabrication. A variable frequency source is potentially inexpensive at low power (e.g. a VCO), but they require high-power microwave amplifiers (>1 kW), which are virtually nonexistent for less than a few hundreds of thousands of dollars.

Other techniques have been proposed to move the target around within the cavity. The disadvantages here are that a mechanical device is necessary to move the target, and the target only can occupy a small portion of the cavity.

The use of meta-structures or artificial electromagnetic materials has yielded methods for creating uniform fields within a microwave waveguide or cavity, such as by a rectangular waveguide that utilizes a hard electromagnetic surface (HES) to enable TEM waves in a waveguide which is applied to an active amplifier array structure for the purpose of high-frequency amplification for communication purposes. A uniform field distribution is desired in this case because it optimizes the amplifiers performance and efficiency. In this regard, U.S. Pat. No. 6,603,357 discloses a rectangular waveguide that utilizes a hard electromagnetic surface to enable TEM waves in a waveguide. It is applied to an active amplifier array structure for the purpose of high-frequency amplification for communication purposes. However, the prior art meta-surfaces are complicated by one or more of the following issues. They either require (1) vias that ground the surface to the waveguide walls, (2) intricate patterns, (3) very high permittivity materials within the structure or they require active materials, or (4) dimensions that are not small compared to the waveguide size.

Therefore, a need exists for a better way of providing uniform microwave heating. Embodiments of the present invention provide solutions to meet such need.

SUMMARY OF THE INVENTION

In accordance with the present invention a method is provided for creating uniform heating of an absorptive target, and, is particularly useful for heating a large-area slab-like or substrate absorptive target. An HES, also known as a "meta-surface", is created on the inner wall of a heating cavity. The HES alters the electromagnetic boundary conditions such that tangential electric fields can exist at the cavity wall, exactly the opposite of a normal conductor, thus allowing the establishment of TEM transverse modes across the cross section. The TEM modes have a profile of a perfectly uniform electric field, thus an absorptive substrate set along the cavity's cross section will experience uniform heating.

While many HES may be known in the prior art, the HES in accordance with the present invention is novel in its geometry, methodology and construction. Although it can appear in many different forms due to variations in parametric details, the basic form is that of a double layer of conductive strips layered near the wall of the heating cavity. The strips are staggered between layers to create an equivalent resonant circuit of inductors and capacitors. The HES in accordance with the present invention differs from other prior art HES in that it is a very low profile and can be inserted unobtrusively within a waveguide or cavity. It does not require high-permittivity materials to enable its function. The characteristic electrical parameters of the circuit are determined by the geometrical factors of the HES geometry. In one embodiment the circuit to be resonant near 2.45 GHz, a frequency where cheap, reliable and high-power microwave sources are available, but this is not required.

In one aspect of the invention a method for uniform microwave heating of a microwave absorptive target includes: providing a microwave housing having a longitudinal axis for propagating a waveguide mode at an operating frequency; locating the microwave absorptive target in an axial cross-sectional area of the microwave housing relative to the longitudinal axis; altering electromagnetic boundary conditions within the microwave housing such that tangential electric fields exist at the cavity wall and transverse electromagnetic modes propagate across the axial cross-sectional area; and applying microwave energy at the operating frequency into the microwave housing to heat the microwave absorptive target. A plurality of first layer conductive strips are layered proximal to an inner wall of the microwave housing to provide a first conductive layer, the inner wall acting as a ground plane, each of the first layer conductive strips being layered substantially parallel to the longitudinal axis and being separated from an adjacent first layer conductive strip by a respective first layer gap. A plurality of second layer conductive strips are layered proximal to the first layer of conductive strips to provide a second conductive layer, each of the second layer conductive strips being layered substantially parallel to the longitudinal axis and being separated from an adjacent second layer conductive strip by a respective second layer gap. Each first layer gap is located to be substantially centered under a respective second layer conductive strip and each second layer gap is located to be substantially centered over a respective second layer conductive strip. The first conductive layer may be separated from the inner wall and the first conductive layer is separated from the second conductive layer by respective layers of dielectric material. The plurality of first layer conductive strips and the plurality of second layer conductive strips are layered to create an equivalent resonant circuit of inductors and capacitors at the operating frequency. The equivalent resonant circuit is resonant near 2.45 GHz. The microwave housing may be a resonant cavity or a waveguide.

In another aspect of the present invention, a microwave apparatus is provided for altering electromagnetic boundary conditions within a microwave housing such that tangential electric fields exist at a inner housing wall of the microwave housing and transverse electromagnetic modes are propagatable across an axial cross-sectional area of the microwave housing. A microwave cavity or waveguide each has a longitudinal axis and are sized to propagate a waveguide mode at an operating frequency. A plurality of first layer conductive strips is layered proximal to an inner wall of the microwave housing to provide a first conductive layer, the inner wall acting as a ground plane, each of the first layer conductive strips being layered substantially parallel to the longitudinal axis and being separated from an adjacent first layer conductive strip by a respective first layer gap. A plurality of second layer conductive strips is layered proximal to the first layer of conductive strips to provide a second conductive layer, each of the second layer conductive strips being layered substantially parallel to the longitudinal axis and being separated from an adjacent second layer conductive strip by a respective second layer gap. Each first layer gap is located to be substantially centered under a respective second layer conductive strip and each second layer gap is located to be substantially centered over a conductive layer. The first conductive layer is separated from the ground plane and the first conductive layer is separated from the second conductive layer by respective layers of dielectric material. The plurality of first layer conductive strips and the plurality of second layer conductive strips are layered to create an equivalent resonant circuit of inductors and capacitors at the operating frequency. The equivalent resonant circuit is resonant near 2.45 GHz.

DETAILED DESCRIPTION OF THE INVENTION

When using microwaves to heat various materials for various purposes, one usually has to live with an inherent non-uniformity in the heating of the target material, due to electromagnetic modes that constrain the heating energy to specific patterns within the heating cavity. Considering that the cavity typically consists of a cylindrical geometry of arbitrary cross section, the most common being rectangular or circular, microwave radiation is introduced into the cavity at a coupler port designed for that purpose. The electromagnetic radiation within the cavity is distributed among several orthonormal cavity modes. Each mode is a solution to the Maxwell's wave equation given the cavity's particular boundary conditions. If the walls of the cavity are made of metal, as is the case for most cavities, the high conductivity dictates that the tangential electric field approaches zero at the cavity walls. The result is that there will be spots within the cavity near the cavity walls where the field is very small, and if any of the target material is placed there, it will experience little or no heating. This effect is enhanced when the transverse dimensions of the cavity are only several times larger than the radiation wavelength.

Figure 1:
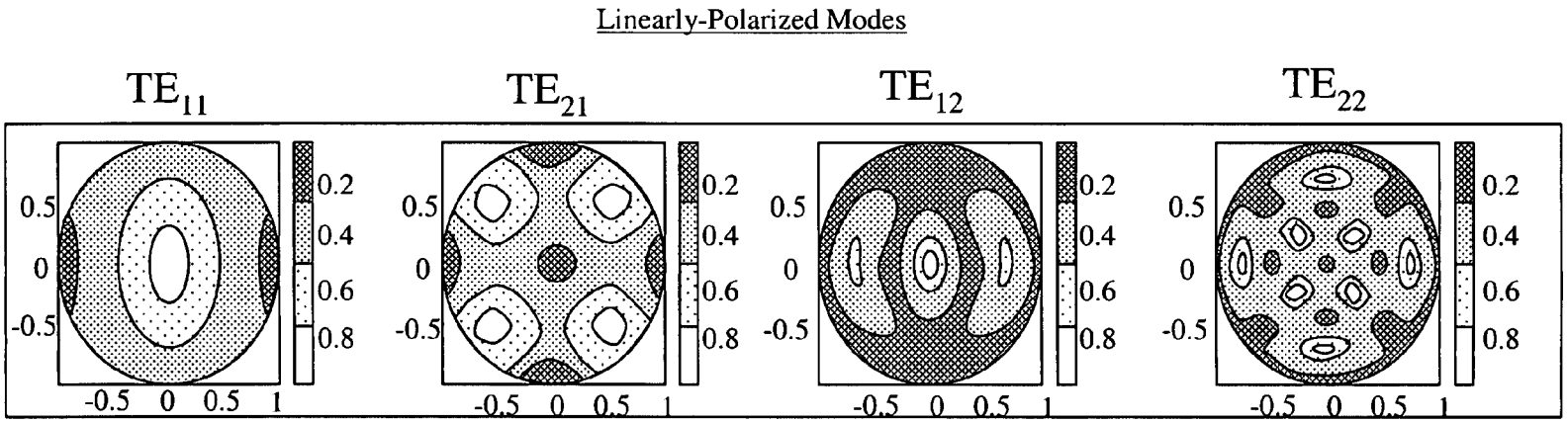
FIG. 1 depicts heat intensities resulting from various linear polarized TE modes propagating in a right circular cylindrical microwave cavity or waveguide.

FIG. 1 illustrates the heating pattern intensity as a function of radius that would be experienced by targets placed across a cross section of a right circular cylindrical cavity (or waveguide) with conductive walls and tuned to support various linearly polarized (LP) cavity modes: $TE_{11}$, $TE_{21}$, $TE_{12}$ and $TE_{22}$. Depicted heating intensity increases from the dark areas to the light areas.

However, in accordance with the present invention non-uniform heating of the target can be prevented by using an HES on the walls of the cavity. The HES modifies the boundary conditions on the walls:

from $$E_T = 0 \text{ and } \frac{\partial E_n}{\partial \hat{n}} = 0$$

to $$\frac{\partial E_T}{\partial \hat{n}} = 0 \text{ and } \frac{\partial E_n}{\partial \hat{n}} = 0$$

thus allowing propagation of a wave with its electric field polarized parallel to the wall to propagate near to the cavity walls.

Consider an embodiment wherein the cavity is a right cylinder (i.e., a cylinder of arbitrary cross-sectional shape that does not vary along the length of the cylinder, and whose ends are capped with a plane that intersects the side wall at a right angle. Then, the cavity modes' electric and magnetic fields can be mathematically separated into parts independently describing their longitudinal and transverse patterns. In a right cylindrical cavity of circular cross section, the transverse field patterns are described by the well-known TE and TM solutions to the circular waveguide problem, while the longitudinal fields vary only as a sinusoid with a period determined by the radiation frequency and the transverse dimension. When such a cavity is lined along its longitudinal walls with HES, the result is that altered boundary conditions allow the TEM waves to propagate along the length of the cylinder and the fields are now uniform across the cavity cross section. When a target to be heated is placed across the cavity cross section, it is uniformly heated in that cross section.

The nature of the HES requires that it be designed for the specific frequency of the heating radiation. Over the design's bandwidth, TEM waves are supported and the electric field is uniform. As the heating radiation frequency deviates from the design frequency, the fields begin to have more and more of the longitudinal wave component and become non-uniform. In most applications, the limited bandwidth of operation is not a problem because the heating radiation is usually within a very narrow range. For example, all commercial microwave systems are operated with magnetrons tuned to 2.45 GHz, and will stay within 10 MHz of that value. Such a frequency variation (0.4%) is small enough to keep it well within the HES' bandwidth (typically 10–30%).

Figure 2:
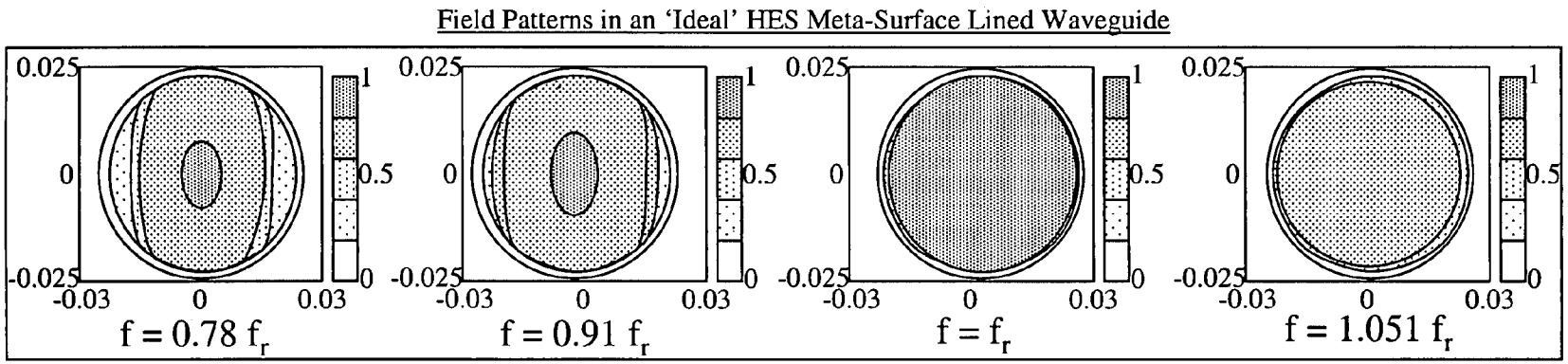
FIG. 2 depicts field patterns/heat intensities in an ideal HES meta-surface layered waveguide and illustrates how the uniformity of an electromagnetic field is affected by moving a heating radiation's frequency through and away from its resonance frequency $f_r$.

FIG. 2 illustrates how the uniformity of the field is affected by moving the heating radiation's frequency through and away from its resonance frequency $f_r$. The heating patterns are in a right circular cavity lined with an "ideal" HES meta-material on its longitudinal walls. Depicted field/heating intensity increases from the dark areas to the light areas. The fields and the heating pattern are uniform at the HES' resonance frequency. As can be seen, as the microwave frequency is moved away from the resonance frequency, the heating patterns become more non-uniform. The present invention is based on a unique layering electromagnetic band gap (EBG) meta-material and can be designed to be very thin and unobtrusive within the heating cavity, approximating the ideal cavity lining.

Figure 3A:
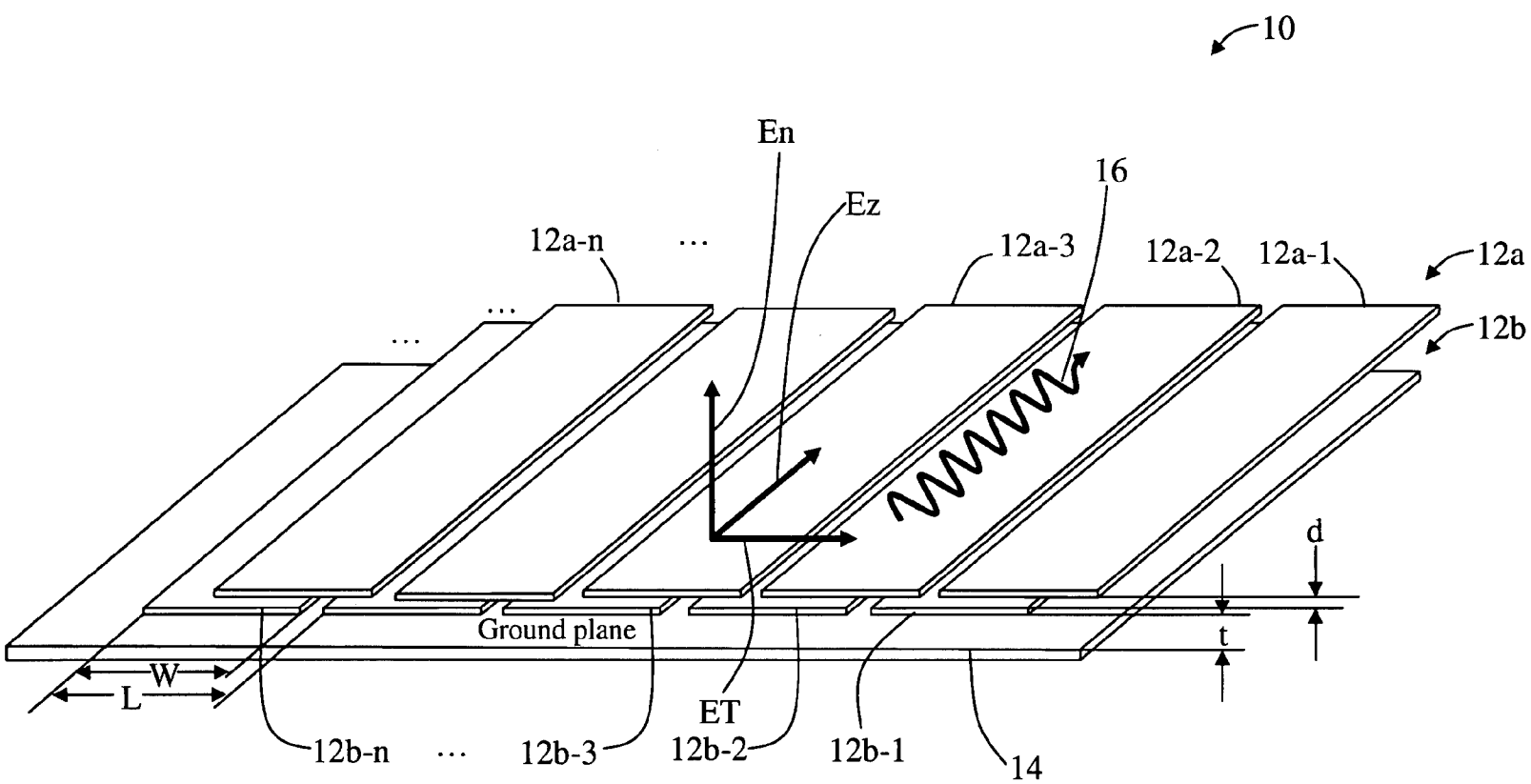
FIG. 3*a* shows a simplified diagram of a double layer of alternating conductive panels or strips offset from the ground plane in accordance with the present invention.

FIG. 3*a* shows a simplified diagram of the HES' geometry as a double layer of alternating conductive panels or strips offset from the ground plane of the cavity wall. HES 10 is composed of a dual layer of the conductive strips having an upper layer 12*a* and a lower layer 12*b* spaced alternately above ground plane 14. Upper layer 12*a* includes a series of panels $\mathbf{12}_{a\text{-}1}$, $\mathbf{12}_{a\text{-}2}$, $\mathbf{12}_{a\text{-}3}$, . . . $\mathbf{12}_{a\text{-}n}$ with gaps therebetween. Lower layer 12*b* includes a series of panels $\mathbf{12}_{b\text{-}1}$, $\mathbf{12}_{b\text{-}2}$, $\mathbf{12}_{b\text{-}3}$, . . . $\mathbf{12}_{b\text{-}n}$ with gaps therebetween. The upper layer gaps are situated such that they are substantially centered over a respective lower layer panel, while the lower layer gaps are situated such that they are substantially centered under a respective upper layer panel. The dimensions (d, t, L, w) determine the meta-surface's electrical characteristics and its resonant frequency and bandwidth. Wave propagation with $E_T \neq 0$ is allowed for propagation along direction 16 of the strips, when the wave frequency is near the HES' resonant frequency. The resonant frequency of the HES is determined by the HES' characteristic inductance (L) and capacitance (C) by $$f_r = 1/\left(2\pi\sqrt{LC}\right).$$

Figure 3B:
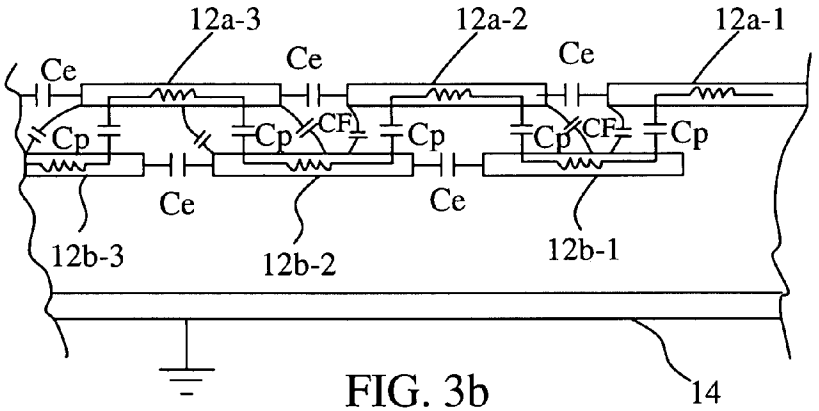
FIG. 3*b* is a simplified plan view schematic diagram depicting capacitance and inductance determined from the double layer of alternating conductive panels or strips offset from the ground plane in accordance with the present invention.

Referring to FIG. 3*b*, the HES capacitance and inductance is in turn are determined from the surface's geometrical dimensions. $L=\mu_0 t$ is the sheet inductance, and the sheet capacitance is the sum of the contributions $C_p$ from the parallel plates between layers, contributions $C_e$ from the edges from strip to strip within the layers, and fringe capacitance $C_f$ from the edges strips of one layer to the body of the strips on the other layer. The parallel capacitance is:

$$C_{parallel} \approx \frac{\varepsilon}{d}\left(w - \frac{1}{2}L\right)^2$$

while the edge-to-edge capacitance is:

$$C_{edge} = \frac{w}{\pi}\langle\varepsilon\rangle\cosh^{-1}\left(\frac{L+w}{L-w}\right)$$

and the fringe capacitance is:

$$C_{fringe} = \frac{2w}{\pi}\langle\varepsilon\rangle\cosh^{-1}\left(\frac{w}{d}\right)$$

The bandwidth of the resonance is $$\frac{\Delta\omega}{\omega_r} = \frac{2\pi t}{\lambda_r}$$

For an HES modeled after the geometry of FIG. 3*a* with d=0.100", w=0.380", L=0.440" and t=0.250", ∈=1.23" the resonant frequency is approximated by the above formulation to be $f_r$=2.38 GHz with a bandwidth of 32%.

Figure 3C:
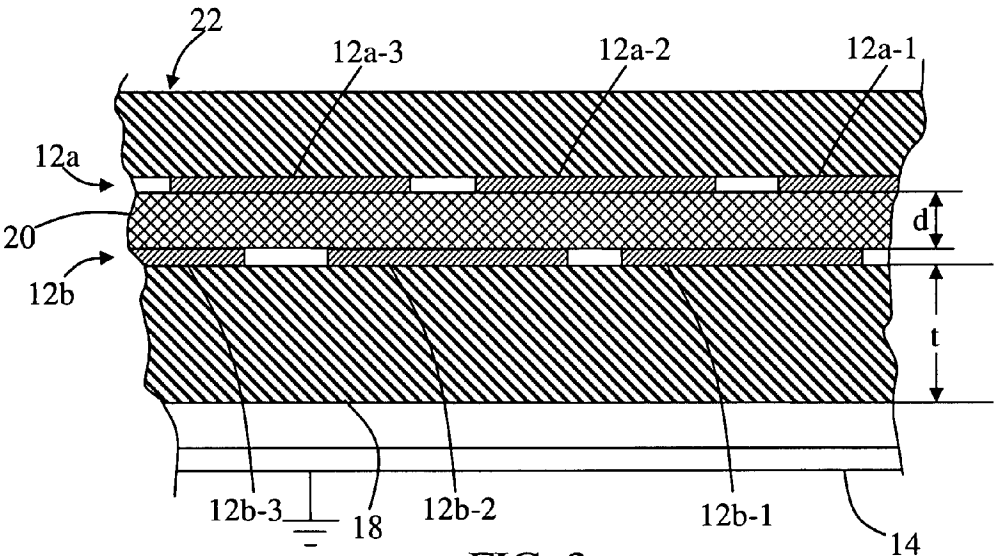
FIG. 3*c* shows in section form a portion of a practical embodiment of the structures shown in FIGS. 3*a* and 3*b*.

Referring to FIG. 3*c*, a portion of a practical embodiment of the structures shown in FIGS. 3*a* and 3*b* is depicted. Ground plane 14 is separated from lower layer 12*b* and its respective panels 12*b*-1, 12*b*-2, 12*b*-3 by dielectric layer 18 made of made of material having a dielectric constant ∈ and a thickness t. Film 20, such as a Kapton film, separates layer 12*a* from layer 12*b*. Dielectric layer 22 is formed over upper layer 12*a*.

For an HES modeled after the geometry of FIG. 3*a* with d=0.100", w=0.380", L=0.440", and t=0.250", ∈=1.23" the resonant frequency is approximated by the above formulation to be $f_r$=2.38 GHz with a bandwidth of 32%.

It is possible to design many variations of this geometry using different dimensions for the critical parameters of d, L, I, w and ∈ that will give essentially identical electrical properties. It is also possible and often desirable to layer dielectric materials of different permittivity between the meta layers and the waveguide walls. One advantage to this is to prevent electrical breakdown between adjacent conductive strips.

An efficient way to determine meta-surface parameters is to start with the approximate equations stated above, and then to model a single cell of a trial meta-surface on an electromagnetic simulation application such as Ansoft's HESS.

Figure 4A:
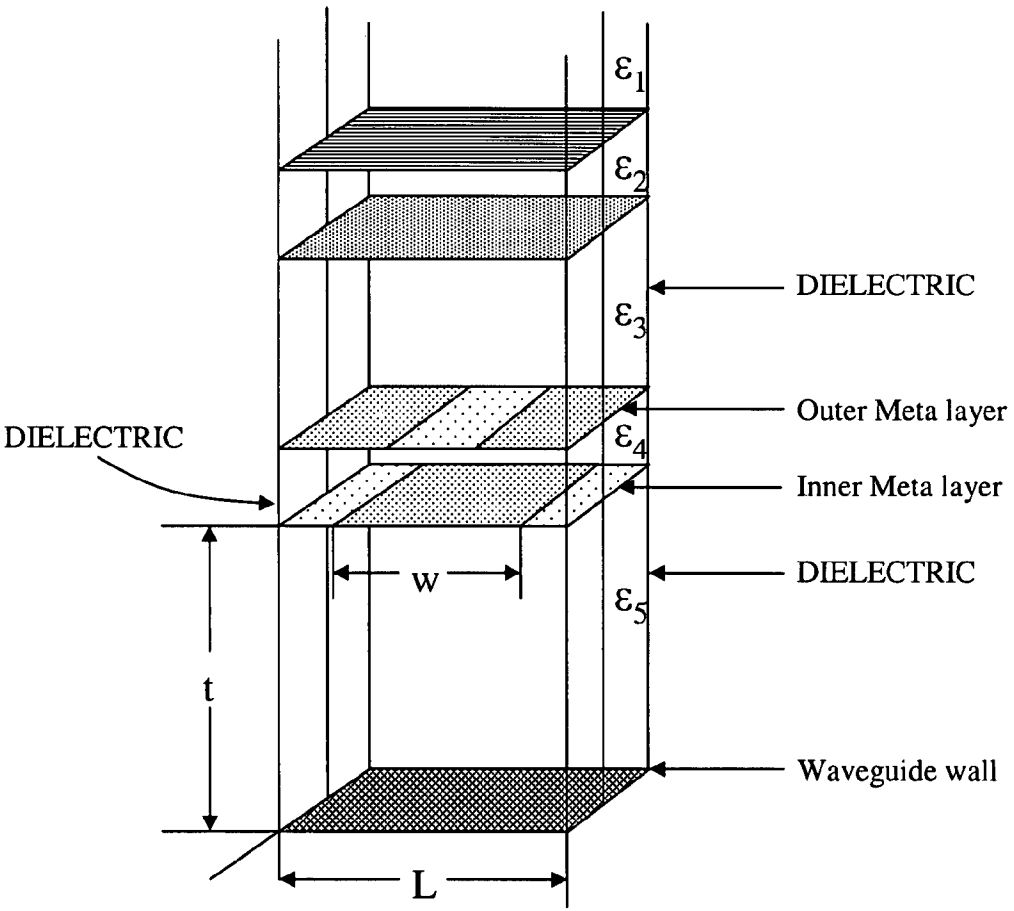
FIGS. 4*a* and 4*b* show respectively a simulation example of a single-cell of the type of structure depicted in FIGS. 3*a*–3*c*. and a resultant S11 response.
Figure 4B:
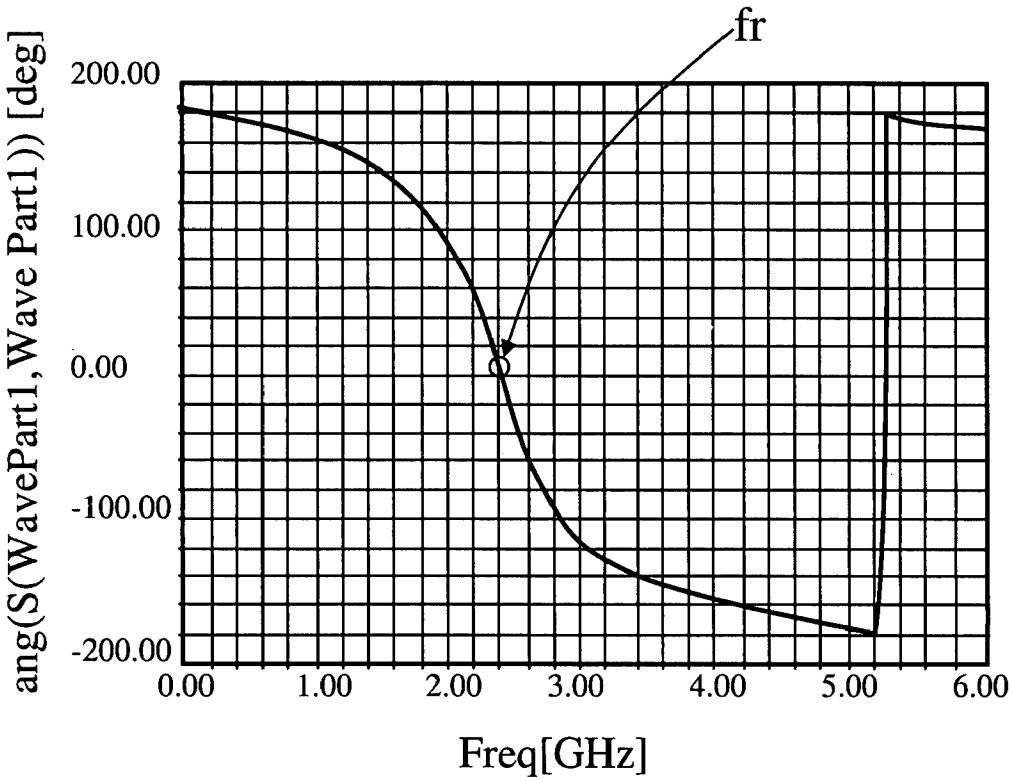

FIGS. 4*a* and 4*b* show a simulation example of one such single-cell of the type of structure depicted in FIGS. 3*a*–3*c*. Shown in FIG. 4*a* is the meta-surface simulation geometry with layers of differing permittivity ($\in_1$–$\in_5$). The operating frequency is determined by analyzing a resultant S11 response shown in FIG. 4*b* and locating the point where the phase crosses 0, thus indicating the resonant frequency $f_r$. The bandwidth is indicated by where the S11 phase crosses the +/−90 degree points.

Figure 5B:
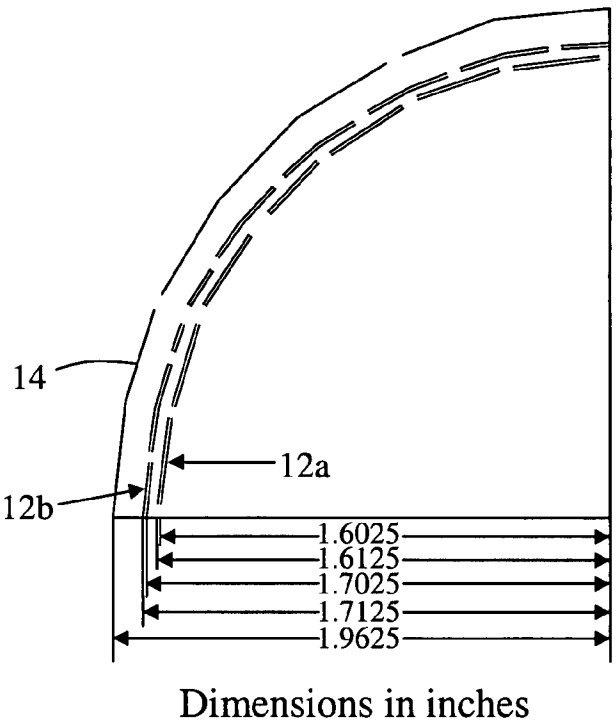
FIG. 5*b* shows a plan view of a quarter of the circular waveguide geometry of the exemplary embodiment of the present invention shown in FIG. 5*a*.
Figure 5A:
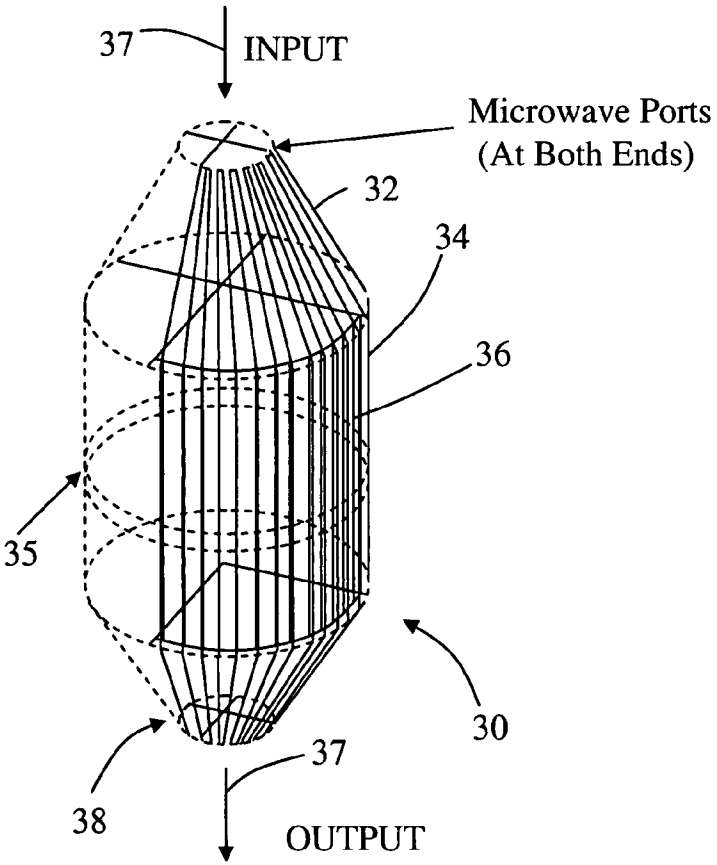
FIG. 5*a* shows an exemplary cylindrical microwave mode propagating housing in accordance with the present invention.
Figure 6A:
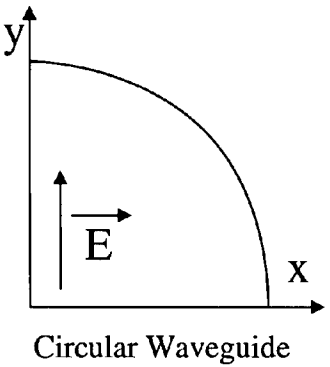
FIGS. 6*a*–6*d*, are field diagrams showing how the fields are made more uniform with the introduction of a meta-surface within the waveguide in accordance with the present invention.
Figure 6B:
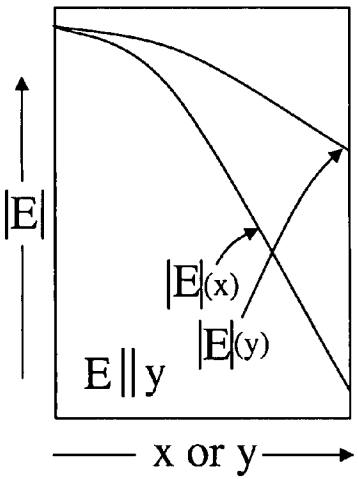
Figure 6C:
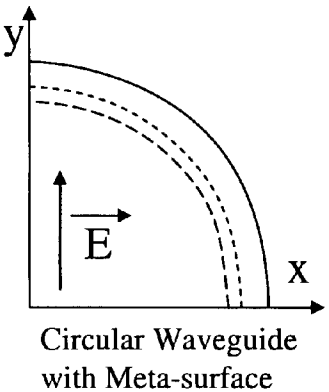
Figure 6D:
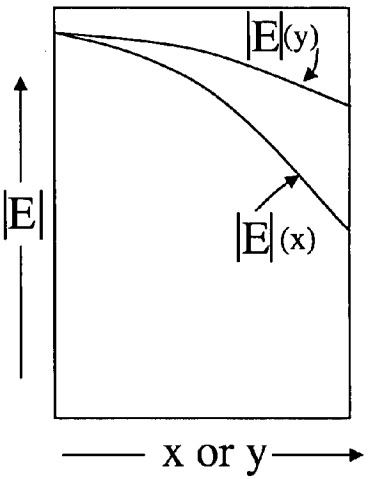

Once the desired operational parameters of have been verified through the electromagnetic simulation, the geometry can be determined, such as an exemplary cylindrical microwave mode propagating housing, which may be a resonant cavity or a waveguide, as shown in FIG. 5*a*. In FIG. 5*a*, a partial perspective view of a quarter of a heating cavity housing 30 is shown, with the remaining portion of the housing shown in phantom. Heating cavity housing 30 has conical RF input port 32, cylindrical center section 34 with a meta-surface 36 installed within the waveguide interior of cylindrical center section 34, and conical RF output port 38. Slab-like target layer 35 to be heated would be situated in an axial cross-sectional area of the microwave housing relative to a longitudinal axis 37 within cylindrical center section 34'. As described above, meta-surface 36 includes a dual layer of parallel panels or strips arranged concentrically with the waveguide wall of cylindrical center section 34 and would span the entire inner circumference of cylindrical center section 34, each of the dual layer of strips being layered substantially parallel to the longitudinal axis 37. FIG. 5*b* shows the meta-surface geometry used in the simulations in a plan view a quarter of the circular waveguide geometry, the meta-surface being composed of two layers 12*a*, 12*b* of parallel metallic strips arranged concentrically with the waveguide wall 14. In this exemplary embodiment there are 28 individual panels in each layer which would encompass the entire inner wall of the cylindrical center section.

Referring now to FIGS. 6*a*–6*d*, the results of the simulations illustrate how the fields are made more uniform with the introduction of the meta-surface within the waveguide. Two different configurations are shown for comparison. First, in FIGS. 6*a* and 6*b* the empty waveguide fields are shown as a baseline case. Second, in FIGS. 6*c* and 6*d* the meta-surface as illustrated in FIGS. 5*a* and 5*b* is shown. The fields are plotted across the radii parallel and perpendicular to the field's polarization.

As seen in FIGS. 6*a*–6*d*, a wave is launched with the electric field polarized along the y axis. The wave propagates in the empty waveguide in a TE11 mode, which dictates that the field vanishes at the waveguide walls at the extreme x extension. The electric field within the waveguides lined with the meta-surfaces is substantially more uniform than in the empty waveguide. The enhancement is substantially more pronounced for fields along the x axis.

Therefore, in accordance with the present invention, a uniform microwave heating capability over a large surface area has been described.

The thermal energy delivered to the process area by electromagnetic absorption of microwave radiation will be applicable to processes where uniform heating is necessary to meet process specifications.

In accordance with embodiments of the present invention, a uniform field of electromagnetic energy can be delivered over a large surface cross section. A non-invasive method of heating substrates is provided. Generally available commercial high-power magnetron microwaves sources may be used. While exemplary embodiments may conveniently operate at 2.45 GHz, a frequency where cheap, reliable and high-power microwave sources are available, but this is not required. Since the source operates at fixed frequency, it is routine to design and fabricate the low-loss, narrow-bandwidth components necessary to complete the design.

Materials manufacturers could use the invention to provide a large area of uniform heating in materials processing stations. For example, deposition of diamond or diamond-like-carbon films used for thermal control requires the substrate to be uniformly heated in order to create a large-area diamond substrate of uniform quality.

The device could also be used to permit higher power levels to be transmitted in a waveguide of a given size; or equivalently, a smaller waveguide to be used for a given power. This may be useful in radar transmitters, for example, where compactness is otherwise difficult to achieve without compromising reliability; or in high-power-microwave weapons, where high power and energy densities are essential.

Other possible applications include sterilization of non-metallic medical equipment or contaminated wastes, cooking food, sintering ceramics, sintering nano materials, and diamond and diamond-like deposition.

Another possible application is in the area low-observables (i.e., low-radar-cross-section surfaces), since meta-layer-covered surfaces do not reflect microwaves in the same manner as continuous conductors.

What is claimed is:

1. A method for uniform microwave heating of a microwave absorptive target comprising:

providing a microwave housing having a longitudinal axis for propagating a waveguide mode at an operating frequency;

locating the microwave absorptive target in an axial cross-sectional area of the microwave housing relative to the longitudinal axis;

altering electromagnetic boundary conditions within the microwave housing such that tangential electric fields exist at the cavity wall and transverse electromagnetic modes propagate across the axial cross-sectional area; and applying microwave energy at the operating frequency into the microwave housing to heat the microwave absorptive target.

2. The method of claim 1, wherein altering the electromagnetic boundary conditions within the microwave housing comprises:

layering a plurality of first layer conductive strips proximal to an inner wall of the microwave housing to provide a first conductive layer, the inner wall acting as a ground plane, each of the first layer conductive strips being layered substantially parallel to the longitudinal axis and being separated from an adjacent first layer conductive strip by a respective first layer gap; and layering a plurality of second layer conductive strips proximal to the first layer of conductive strips to provide a second conductive layer, each of the second layer conductive strips being layered substantially parallel to the longitudinal axis and being separated from an adjacent second layer conductive strip by a respective second layer gap;

wherein each first layer gap is located to be substantially centered under a respective second layer conductive strip and each second layer gap is located to be substantially centered, over a respective second layer conductive strip.

3. The method of claim 2, wherein the first conductive layer is separated from the inner wall and the first conductive layer is separated from the second conductive layer by respective layers of dielectric material.

4. The method of claim 2 wherein the plurality of first layer conductive strips and the plurality of second layer conductive strips are layered to create an equivalent resonant circuit of inductors and capacitors at the operating frequency.

5. The method of claim 4, wherein the equivalent resonant circuit is resonant near 2.45 GHz.

6. The method of claim 1, wherein the microwave housing is a resonant cavity or a waveguide.

7. A microwave heating apparatus for uniform heating of a microwave absorptive target comprising:

a microwave housing having a longitudinal axis and sized to propagate a waveguide mode at an operating frequency, the microwave housing having an axial cross-sectional area relative to the longitudinal axis for locating the microwave absorptive target, wherein the microwave housing includes:

a plurality of first layer conductive strips layered proximal to an inner wall of the microwave housing to provide a first conductive layer, the inner wall acting as a ground plane, each of the first layer conductive strips being layered substantially parallel to the longitudinal axis and being separated from an adjacent first layer conductive strip by a respective first layer gap; and a plurality of second layer conductive strips layered proximal to the first layer of conductive strips to provide a second conductive layer, each of the second layer conductive strips being layered substantially parallel to the longitudinal axis and being separated from an adjacent second layer conductive strip by a respective second layer gap; and wherein each first layer gap is located to be substantially centered under a respective second layer conductive strip and each second layer gap is located to be substantially centered over a respective second layer conductive strip.

8. The microwave heating apparatus of claim 7, wherein the first conductive layer is separated from the inner wall and the first conductive layer is separated from the second conductive layer by respective layers of dielectric material.

9. The microwave heating apparatus of claim 7, wherein the plurality of first layer conductive strips and the plurality of second layer conductive strips are layered to create an equivalent resonant circuit of inductors and capacitors at the operating frequency.

10. The method of claim 9, wherein the equivalent resonant circuit is resonant near 2.45 GHz.

11. The method of claim 7, wherein the microwave housing is a resonant cavity or a waveguide.

12. A microwave apparatus for altering electromagnetic boundary conditions within a microwave housing such that tangential electric fields exist at a inner housing wall of the microwave housing and transverse electromagnetic modes are propagatable across an axial cross-sectional area of the microwave housing, comprising:

a microwave cavity or waveguide, each having a longitudinal axis and sized to propagate a waveguide mode at an operating frequency;

a plurality of first layer conductive strips layered proximal to an inner wall of the microwave housing to provide a first conductive layer, the inner wall acting as a ground plane, each of the first layer conductive strips being layered substantially parallel to the longitudinal axis and being separated from an adjacent first layer conductive strip by a respective first layer gap; and a plurality of second layer conductive strips layered proximal to the first layer of conductive strips to provide a second conductive layer, each of the second layer conductive strips being layered substantially parallel to the longitudinal axis and being separated from an adjacent second layer conductive strip by a respective second layer gap;

wherein each first layer gap is located to be substantially centered under a respective second layer conductive strip and each second layer gap is located to be substantially centered over a respective second layer conductive strip.

13. The microwave apparatus of claim 12, wherein the first conductive layer is separated from the inner wall and the first conductive layer is separated from the second conductive layer by respective layers of dielectric material.

14. The microwave heating apparatus of claim 12, wherein the plurality of first layer conductive strips and the plurality of second layer conductive strips are layered to create an equivalent resonant circuit of inductors and capacitors at the operating frequency.

15. The microwave apparatus of claim 14, wherein the equivalent resonant circuit is resonant near 2.45 GHz.

* * * * *